US011320761B2

(12) United States Patent
Chang et al.

(10) Patent No.: US 11,320,761 B2
(45) Date of Patent: May 3, 2022

(54) CHARGE ROLLER VOLTAGE DETERMINATION

(71) Applicant: Hewlett-Packard Development Company, L.P., Spring, TX (US)

(72) Inventors: Seongsik Chang, Palo Alto, CA (US); Brad Thomas Dransfield, Boise, ID (US); Eric G. Nelson, Boise, ID (US); Bruce J. Jackson, Boise, ID (US); Omer Gila, Palo Alto, CA (US); Anthony William McLennan, Palo Alto, CA (US); Asaf Anufa, Ness Ziona (IL); Daniel Espinosa, Palo Alto, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/254,919

(22) PCT Filed: Dec. 20, 2018

(86) PCT No.: PCT/US2018/066761
§ 371 (c)(1),
(2) Date: Dec. 22, 2020

(87) PCT Pub. No.: WO2020/131064
PCT Pub. Date: Jun. 25, 2020

(65) Prior Publication Data

US 2021/0302860 A1 Sep. 30, 2021

(51) Int. Cl.
*G03G 15/02* (2006.01)
*G03G 15/10* (2006.01)

(52) U.S. Cl.
CPC ..... *G03G 15/0266* (2013.01); *G03G 15/10* (2013.01)

(58) Field of Classification Search
CPC ..... G03G 15/0266; G03G 15/10–11
See application file for complete search history.

(56) References Cited

U.S. PATENT DOCUMENTS

| | | | | |
|---|---|---|---|---|
| 6,611,665 | B2 * | 8/2003 | DiRubio | G03G 15/1675 399/66 |
| 6,806,895 | B2 | 10/2004 | Jeong | |
| 7,630,659 | B2 | 12/2009 | Uchitani et al. | |
| 7,684,719 | B2 | 3/2010 | Kitajima | |
| 7,715,742 | B2 | 5/2010 | Burry et al. | |
| 9,423,717 | B2 * | 8/2016 | Chang | G03G 15/0233 |
| 9,551,950 | B2 | 1/2017 | Sato et al. | |
| 2007/0189787 | A1 | 8/2007 | Hagiwara et al. | |
| 2008/0101807 | A1 | 5/2008 | Burry et al. | |
| 2008/0152369 | A1 * | 6/2008 | DiRubio | G03G 15/553 399/48 |
| 2008/0152371 | A1 * | 6/2008 | Burry | G03G 15/5062 399/50 |

(Continued)

FOREIGN PATENT DOCUMENTS

| | | |
|---|---|---|
| JP | 2016507076 | 3/2016 |
| WO | WO-2014120155 | 8/2014 |

*Primary Examiner* — Carla J Therrien
(74) *Attorney, Agent, or Firm* — Dicke Billig & Czaja PLLC

(57) ABSTRACT

An electrophotographic printer includes a charge roller in charge-transferring relation to a photoconductive imaging portion. The printer may determine an AC voltage setpoint of the charge roller.

17 Claims, 8 Drawing Sheets

(56) References Cited

U.S. PATENT DOCUMENTS

| | | | | |
|---|---|---|---|---|
| 2008/0170869 | A1* | 7/2008 | Ramesh | G03G 15/0266 399/49 |
| 2010/0061747 | A1 | 3/2010 | Choi | |
| 2010/0086321 | A1* | 4/2010 | Burry | G03G 15/0266 399/44 |
| 2016/0216631 | A1* | 7/2016 | Gila | G03G 15/02 |

* cited by examiner

CHARGE ROLLER VOLTAGE DETERMINATION

BACKGROUND

Electrophotography has revolutionized high speed and high volume printing. Via electrophotography, digital printers or presses perform print jobs without films or the plates that are typically associated with traditional offset lithography. Accordingly, among other features, a press operator can change the content while the digital press is still completing other jobs, allowing digital printing services to be more nimble and flexible than printing services employing traditional offset lithography.

DETAILED DESCRIPTION

Figure 1:
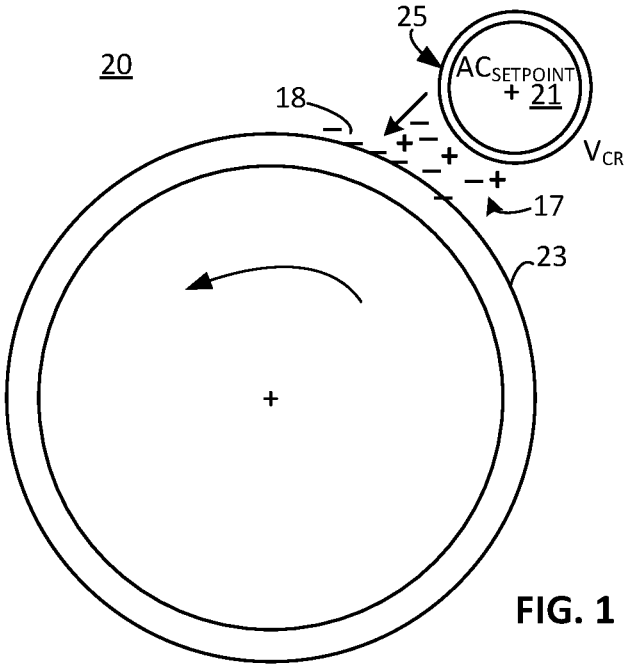
FIG. 1 is a side view schematically representing an example portion of an electrophotographic printer including a charge roller and a photoconductive imaging portion.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense. It is to be understood that features of the various examples described herein may be combined, in part or whole, with each other, unless specifically noted otherwise.

At least some examples of the present disclosure relate to determining an AC voltage setpoint for a charge roller which is high enough to ensure uniform charging of a photoconductive imaging portion yet low enough to avoid unnecessary degradation of the photoconductive imaging portion, which might otherwise occur due to excess charge transfer and/or high AC voltage amplitude.

In some examples, an electrophotographic printer comprises a charge roller in charge-transferring relation to a photoconductive imaging portion for which an AC voltage setpoint of the charge roller may be determined. In some examples, the printer comprises a control portion to perform the determination. In some examples, the AC voltage setpoint may correspond to a maximum value which is some percentage greater than a total charge transferrable from the charge roller to the photoconductive imaging portion at a minimum value of the AC voltage setpoint. Among other aspects, a minimum value of the AC voltage setpoint may ensure uniform image quality, which might not otherwise be achieved due to vibration, dimensional variations in the surface of the charge roller and/or of the photoconductive imaging portion, and/or other causes of dimensional variations in a gap (e.g., intended non-contact operation) or contact interface between a charge roller and a photoconductor. In some examples, the maximum value of the AC voltage setpoint is determined and implemented to decrease a rate and/or decrease a total volume of contamination build-up (e.g. oxidized isoparaffin residue) on the photoconductor that might otherwise occur if the value of AC voltage setpoint were too high. In some examples, the maximum value of the AC voltage setpoint is determined and implemented to decrease the rate of wear on the surface of the photoconductor, which might otherwise occur of the value of the AC voltage setpoint were too high. With this in mind, in some examples, the maximum value may be determined such that a range of values of the AC voltage setpoint may be selected between (and including) the minimum value and the maximum value. It will be further understood that in some examples, the maximum value and the minimum value may be merged such that AC voltage setpoint may be considered a stand-alone value without being part of a range of values. Further details regarding the minimum value and maximum value are described later.

In some examples, the control portion is to operate the printer, after the determination, without adjusting the AC voltage setpoint during printing operations throughout at least a majority of a lifetime of the photoconductive imaging portion. In some such examples, the control portion is to operate the printer, after the determination, without actively adjusting the AC voltage setpoint during print production operations. Via this arrangement, a longevity of the photoconductive imaging portion may be preserved while still achieving generally uniform imaging quality.

In some examples, the electrophotographic printer comprises a liquid electrophotographic printer. In some such examples, the liquid electrophotographic printer may minimize or avoid abrasion which may sometimes occur with dry electrophotographic printing, which may in turn decrease a thickness of a photoconductive portion of the dry electrophotographic printer.

In some examples, the determination of the AC voltage setpoint is performed without printing imaging output via the printer to observe non-uniformities in imaging. In other words, the determination can be made without printing sample images to look for non-uniformities. However, if desired in some examples, one may print sample images to inspect for non-uniformities to confirm the accuracy of a determination.

These examples, and additional examples, are further described below in association with at least FIGS. 1-11.

FIG. 1 is a diagram including a side view schematically representing a portion of an example electrophotographic printer 20.

As shown in FIG. 1, the printer 20 comprises a charge roller 25 and photoconductive imaging portion 23. In general terms, the charge roller 25 is in charge-transferring relation with the photoconductive imaging portion 23 in order to deposit electric charges 17 on the photoconductive imaging portion 23 during operation of the printing system for printing. In some such examples the charging may occur at charge roller voltages at or above a charging threshold voltage, such as a Paschen voltage. Further details re such charging threshold voltages will be described later in association with at least FIG. 7.

In some examples, the photoconductive imaging portion 23 may comprise a photoconductive imaging plate.

Figure 2:
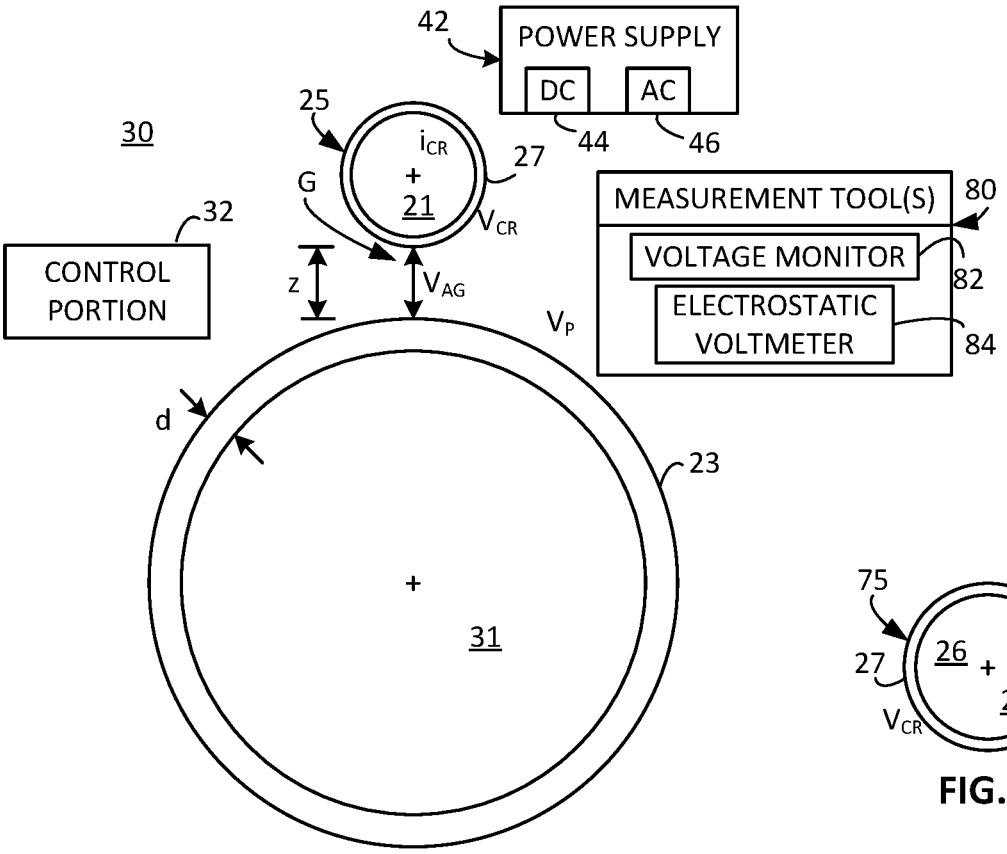
FIG. 2 is a diagram including a side view schematically representing an example charge roller and example photoconductive imaging portion of an electrophotographic printer, in association with an example control portion, an example power supply station, and/or example measurement tools.

In some examples, the charge roller 25 is positioned to be in charge-transferring relation to, and spaced apart by an air gap G from, a photoconductive imaging portion 23, as shown in at least FIGS. 1-2. However, it will be understood that in some examples the charge roller 25 may be in rolling contact with the photoconductive imaging portion 23 while in charge-transferring relation to the photoconductive imaging portion 23.

In some examples, the printer is to determine an AC voltage setpoint by which charges 17 (e.g. electrons, positive charges/ions) will be transferred from the charge roller 25 to the photoconductive imaging portion 23 at a volume and/or rate, which may achieve generally uniform imaging while avoiding transfer of excess total charge from the charge roller to the photoconductive imaging portion 23, which might otherwise cause premature degradation of the photoconductive imaging portion 23. As represented via FIG. 1, after such charging, a net negative charge 18 will be present on the photoconductive imaging portion 23 which also can be represented by an average voltage (e.g. a negative voltage) present on the photoconductive imaging portion 23, as further described later.

In some examples, the printer is to operate, after the determination, without adjusting the AC voltage setpoint during printing operations throughout at least a majority of a lifetime of the photoconductive imaging portion 23. In some such examples, the lifetime of the photoconductive imaging portion 23 may comprise on the order of 100,000 cycles of use, such as 98,000 cycles, 99,000 cycles, 100,000 cycles, 101,000 cycles, 102,000 cycles. In some examples, each cycle of use may sometimes be referred to an impression. In some examples, the AC voltage setpoint may be determined according to examples of the present disclosure and not adjusted throughout an entire lifetime of the photoconductive imaging portion 23.

In some examples, the lifetime may comprise on the order of 90,000 cycles of use, such as 88,000 cycles, 89,000 cycles, 90,000 cycles, 91,000 cycles, 92,000 cycles. In some examples, the lifetime may comprise on the order of 80,000 cycles of use, such as 78,000 cycles, 79,000 cycles, 80,000 cycles, 81,000 cycles, 82,000 cycles. In some examples, the lifetime may comprise on the order of 70,000 cycles of use, such as 68,000 cycles, 69,000 cycles, 70,000 cycles, 71,000 cycles, 72,000 cycles.

In some such examples regarding a lifetime of the photoconductive imaging portion 23, at least a majority of a lifetime may comprise about 50 percent (e.g. 49.5, 50, 50.5 percent) in some examples, on the order of 55 percent (e.g. 53, 54, 55, 56, 57) in some examples, on the order of 60 percent (e.g. 58, 59, 60, 61, 62) in some examples, on the order of 65 percent (e.g. 63, 64, 65, 66, 67) in some examples, and more than 70 percent of a lifetime of the photoconductive imaging portion.

In some examples, the AC voltage setpoint may comprise a single voltage. In some examples, the AC voltage setpoint may comprise a range of voltages including a minimum value (at which uniform imaging will occur) and a maximum value at which the total charges beyond the total charges associated with the minimum value do not unreasonably degrade the photoconductive imaging portion 23, such that the photoconductive imaging portion 23 may be used throughout its full expected lifetime.

In some examples, the maximum value of the AC voltage setpoint is determined and implemented to decrease a rate and/or decrease a total volume of contamination build-up (e.g. oxidized isopar residue) on the photoconductive imaging portion 23 which might otherwise occur if the value of AC voltage setpoint were too high. In some examples, the maximum value of the AC voltage setpoint is determined and implemented to decrease the rate of wear on the surface of the photoconductor, which might otherwise occur of the value of the AC voltage setpoint were too high. With this in mind, in some examples, the maximum value may be determined such that a range of values of the AC voltage setpoint may be selected between (and including) the minimum value and the maximum value. It will be further understood that in some examples, the maximum value and the minimum value may be merged such that AC voltage setpoint may be considered a standalone value without being part of a range of values.

In some examples, the maximum value may be expressed as a percentage of total charge transferred to the photoconductive imaging portion 23 which is in addition to (e.g. more than) the amount of total charge transferred to the photoconductive imaging portion 23 at the minimum value AC voltage setpoint. Examples of such minimum values and maximum values, and examples of their determination, are described further below.

In some examples, the maximum value is on the order of 35 percent (e.g. 33 percent, 34 percent, 36 percent, 37 percent) more than the total charge transferable from the charge roller 25 to the photoconductive imaging portion 23 at a minimum value of the AC voltage setpoint. In some examples, the maximum value is on the order of 30 percent more (e.g. 28 percent, 29 percent, 31 percent, or 32 percent) of the total charge transferrable at the minimum value. In some examples, the maximum value may be on the order of 25 percent (e.g. 23, 24, 25, 26, 27 percent) more, while in some examples, the maximum value is on the order of 20 percent (e.g. 18, 19, 20, 21, 22 percent) more than the minimum value. In some examples, the maximum value may be on the order of 15 percent (e.g. 13, 14, 15, 16, 17 percent) more than the total charge transferrable at the minimum value, while in some examples, the maximum value may be on the order of 10 percent (e.g. 8, 9, 10, 11, 12 percent) more than the total charge transferrable at the minimum value. In some examples, the maximum value may be on the order of 5 percent (e.g. 3, 4, 5, 6, 7 percent) more than the total charge transferrable at the minimum value.

In some examples, the minimum value of the AC voltage setpoint corresponds to the voltage of the photoconductive imaging portion 23 changing negligibly in response to further increases in the AC voltage of the charge roller. In some examples, the minimum value of the AC voltage setpoint corresponds to a point at which a further increase in the AC voltage of the charge roller 25 results in less than on the order of one-half percent (e.g. 0.004, 0.005, 0.006) increase in the voltage of the photoconductive imaging portion 23. In some examples, the minimum value of the AC voltage setpoint corresponds to a point at which a further increase in the AC voltage of the charge roller 25 results in less than one percent (e.g. 0.9, 1.0, 1.1) increase in the voltage of the photoconductive imaging portion 23. At least some details regarding such determination of a minimum value of the AC voltage setpoint are further described below in association with at least FIGS. 4-6.

FIG. 2 is a side view schematically representing an example electrophotographic printer 30, which comprises at least the features and attributes of electrophotographic printer 20 in FIG. 1 and which comprises additional features and attributes as described below. In some examples, electrophotographic printer 30 comprises one example implementation of electrophotographic printer 20.

In some examples, a determination of the AC setpoint for charge roller 25 of printer 30 can be made based on, at least, a first measured voltage (e.g. $V_{CR}$) of the charge roller 25 and a second measured voltage (e.g. $V_P$) of the photoconductive imaging portion 23. Accordingly, in some examples, a control portion 32 of printer 30 includes instructions to receive the first measured voltage of the charge roller and/or to receive the second measured voltage of the photoconductive imaging portion 23.

In some such examples, the respective first measured voltage and/or second measured voltage are determined via elements, tools, instrumentation, etc. which are on-board the electrophotographic printer 30 as later shown in the example of FIG. 2. Therefore the control portion 32, shown in FIG. 2, may receive this information (e.g. measured voltages, currents, etc.) from the electrophotographic printer 20 itself.

In some such examples, via such elements, tools, instrumentation, etc. the respective measured values are automatically determined via the electrophotographic printer 30 upon installation and/or calibration of the charge roller 25 into charge-transferring relation with the photoconductive imaging portion 23. However, in some examples, at least one of the first measured voltage and/or second measured voltage are determined via user interaction with the printer 20 and then received as information to be used and/or stored in the control portion 32 of the electrophotographic printer 30.

In some examples, the determination of the AC voltage setpoint may occur at a manufacturing stage, at factory installation stage, at initial printer installation, at periodic (e.g. daily, weekly, etc.) initialization or maintenance, and/or at other points in time. In some examples, the determination may sometimes occur as part of calibrating the printer 20 for operation and/or may sometimes be referred to as a calibration.

In some examples, at least some of the determined information regarding the AC voltage setpoint may be information stored in memory via control portion 32 and/or at least some information by which the AC voltage setpoint may be determined may be stored in memory via control portion 32. In some such examples, this stored information may take the form of a reference tool (e.g. lookup table), graph, and the like.

In this way, a user, installer, operator, etc. at the electrophotographic printer 30 can determine an AC voltage setpoint for the charge roller 25 which is within a suitable range of acceptable AC voltage setpoints for desired performance of the charge roller in uniformly or substantially uniformly charging the photoconductive imaging portion 23 without transferring surplus charges to the photoconductive imaging portion 23 and/or without operating at high AC voltage amplitudes (either of which might otherwise cause premature wear and degradation of the photoconductive imaging portion 23).

In some examples, it may be determined that the AC voltage setpoint is no longer within the suitable range, such as after extended operation over a large number of impressions. Stated differently, the minimum value and/or the maximum value may shift to some degree over such extended operation, which may in turn make desirable an adjustment to the AC voltage setpoint. In such situations, a manual or automatic adjustment may be implemented to change the AC voltage setpoint for the charge roller 25 and its associated photoconductive imaging portion 23 in order to achieve generally uniform imaging without unnecessary charge transfer to the photoconductive imaging portion 23. The adjustment may be made by adjusting the minimum value, adjusting the maximum value, and/or adjusting an AC voltage setpoint within an originally determined minimum value and originally determined maximum value.

In some examples, the first voltage $V_{CR}$ of charge roller 25 (e.g. at an external surface 27) may be determined from a power supply voltage monitor, such as implemented as at least part of the example power supply 42 shown in FIG. 2. As shown in FIG. 2, a voltage across the air gap G may be represented via identifier $V_{AG}$.

In some examples, the power supply 42 generates a voltage potential $V_{CR}$ at the external surface 27 (FIG. 2) of the charge roller 25 to deposit electric charges 17 on the photoconductive imaging portion 23.

As shown in FIG. 2, a power supply portion 42 may be coupled relative to the charge roller 25 in a manner to permit rotation of the charge roller 25 relative to the photoconductive imaging portion 23 while supplying and controlling the charge roller voltage $V_{CR}$. In some examples, power supply 42 charges the charge roller 25 (and thereby charges photoconductive imaging portion 23) via a DC component 44, an AC component 46, or a combination of both in order to optimize stable and uniform charging of the photoconductive imaging portion 23 to compensate for various material properties, material thicknesses, and distance variances. Further details regarding at least the AC component 46 and/or DC component 44 will be described later throughout various examples, and with particular attention to determining an AC voltage setpoint in accordance with examples of the present disclosure.

In some examples, the photoconductive imaging portion 23 forms an outer layer of a photoconductor drum 31 in FIG. 2, such as but not limited to, the photoconductor drum 328, as further described later in association with at least FIG. 9. As shown in FIG. 2, a voltage of the photoconductive imaging portion 23 is represented by identifier $V_P$, and in some examples, may be determined from a measurement tool, such as measurement tool(s) 80 in FIG. 2. In some examples, the above-noted example measurement tools or other measurement tools may be an on-board measurement tool of the electrophotographic printer 30. In some examples, via the on-board measurement tool(s) 80, the control portion 32 may perform the determination without using a physical or electronic measurement tool independent of the electrophotographic printer 30.

In some examples, the measurement tools 80 may comprise an electrometer 84 by which the voltage of the photoconductive imaging portion 23 may be measured. In some such examples, the voltmeter 84 may comprise a non-contact electrostatic voltmeter. As schematically represented by FIG. 2, in some examples non-contact electrostatic voltmeter may be locatable a few millimeters away from a surface of the photoconductive imaging portion (e.g. 23 in FIG. 1).

As further shown in FIG. 2, in some examples the measurement tool(s) 80 may comprise a voltage monitor 82 to measure the voltage of charge roller 25. In some examples, voltage monitor 82 may comprise one example implementation of a voltage supply monitor which may form part of, or be used in association with, a power supply portion 42.

In some examples, the control portion 32 may be implemented as, and/or comprise at least some of substantially the same features and attributes as the control portion 1000 as later described in association with at least FIGS. 10A-10B. In some such examples, control portion 32 may comprise the above-described stored information and/or provide access to such stored information. Accordingly, the above-described stored information may comprise or be implemented as the stored information 1012 in FIG. 10A, in some examples.

It will be understood that the elements shown in at least FIGS. 1-2 are depicted for illustrative purposes and are not necessarily to scale. For example, in at least some instances the charge roller 25 may be much smaller in proportion relative to a drum 31 providing photoconductive imaging portion 23.

Figure 3:
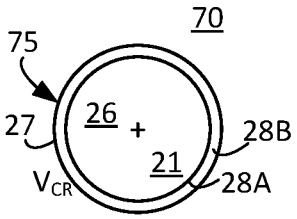
FIG. 3 is a diagram schematically representing an example charge roller.

FIG. 3 is a diagram 70 including a side view schematically illustrating an example charge roller 75 of an electrophotographic printer 20, 30. In some examples, the charge roller 75 may comprise at least some of substantially the same features and attributes as charge roller 25 and/or may comprise one example implementation of charge roller 25. In some examples, the external surface 27 of charge roller 25 comprises a hard external surface. In some examples, the hardness may comprise a hardness of about 5 GigaPascals (GPa) to about 22 GPa on a Vickers hardness scale. Moreover, in some examples, the external surface 27 may comprise a metal surface 28A and a hard resistive layer 28B overlying the metal surface 28A, as shown in FIG. 3. In some examples, the resistive layer 28B comprises an inorganic, non-polymeric material. Via some such example arrangements, the example charge roller 25 may sometimes referred to in this description as being "permanent" at least in the sense that once installed (e.g. removably inserted), the charge roller 25 may have a longevity corresponding to a longevity of the electrophotographic printer in which it is installed or at least a longevity significantly greater than typical charge rollers.

In some examples, the above-described hardness of the external surface 27 of the charge roller 25 may facilitate maintaining a consistent dimensional relationship relative to the photoconductive imaging portion 23, such as compared to situations in which the charge roller 25 may have a softer, less regular outer surface, which in turn may produce dimensional variance, which in turn may lead to non-uniform imaging in some instances. Accordingly, the above-described hardness may sometimes be associated with consistent dimensional spacing between the charge roller and the photoconductive imaging portion, which may in turn promote consistency and uniformity in image quality resulting from consistent charge transfer over a lifetime of a photoconductive imaging portion 23 and/or a lifetime of a charge roller 25.

Figure 4:
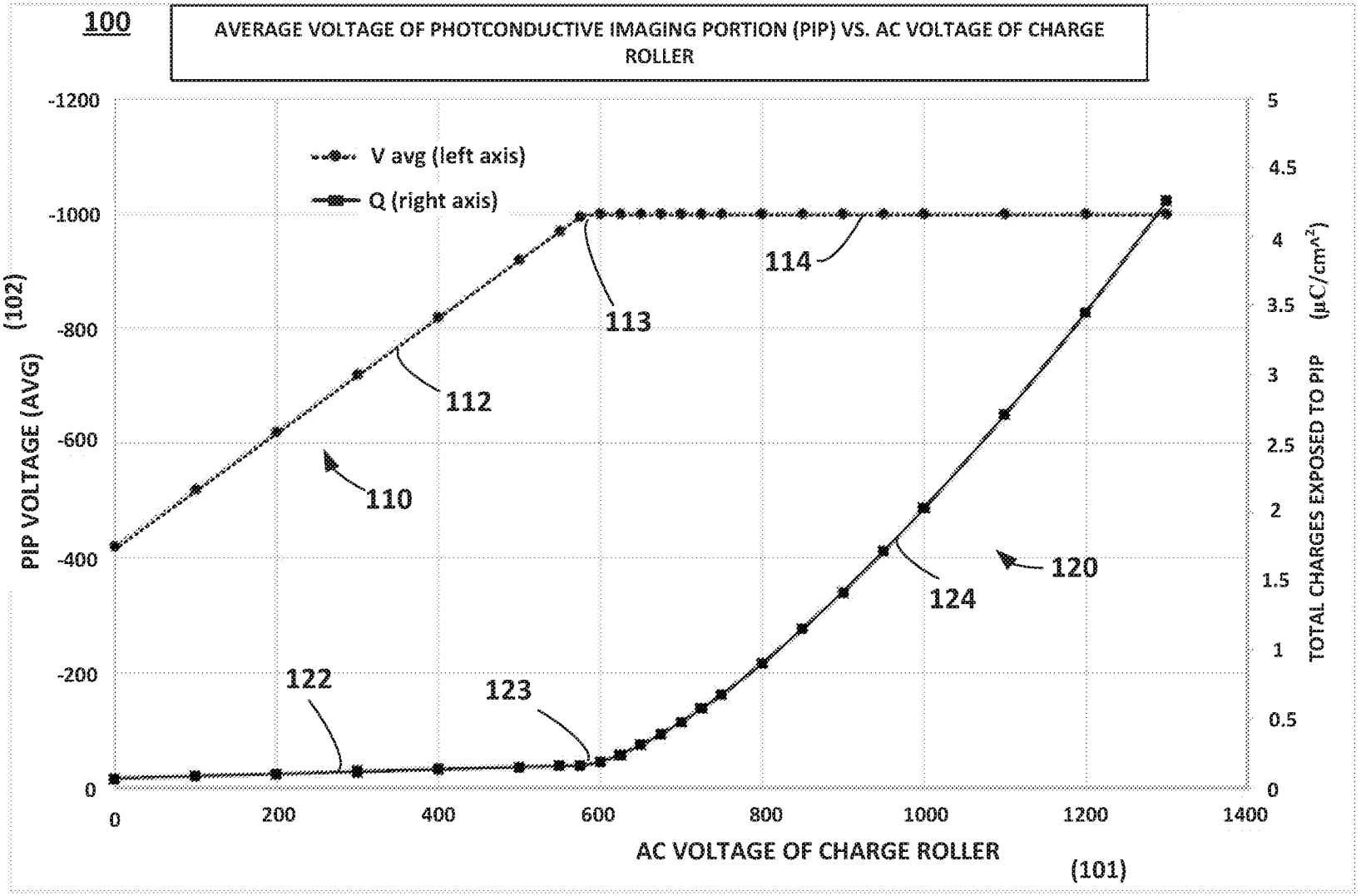
FIG. 4 is a graph including an example plot of an average voltage of a photoconductive imaging portion, and of total charges exposed to the photoconductive imaging portion, relative to an AC voltage of a charge roller.

FIG. 4 is a graph 100 including an example plot of an average voltage of a photoconductive imaging portion, and of a total charge exposed to the photoconductive imaging portion, relative to an AC voltage of a charge roller. In some examples, the voltages represented in FIG. 4 correspond to an example charge roller and/or example photoconductive imaging portion having at least some of substantially the same features and attributes as represented in association with at least FIGS. 1-3. As shown in FIG. 4, the graph 100 comprises an x-axis 101 corresponding to an AC voltage of the charge roller, while a first y-axis 102 corresponds to an average voltage of the photoconductive imaging portion (PIP), and with a second y-axis 103 corresponding to for the total charges exposed to the photoconductive imaging portion (PIP), which may in turn be representative of a total charge transferred from the charge roller 25 to the photoconductive imaging portion 23 (FIGS. 1-3). It will be understood that FIG. 4 represents operation of a printer in which the voltage of the charge roller also comprises a DC component in addition to the AC voltage represented along the x-axis 101. Moreover, it will be further understood that the average voltage of the photoconductive imaging portion (PIP) represented by y-axis 102 starts at −400 Volts for illustrative simplicity to enable juxtaposing both curves 110, 120 in a single graph.

In some examples, the first curve 110 in graph 100 of FIG. 4 includes a first segment 112 which represents the situation in which increasing amounts of AC voltage at charge roller 25 causes the photoconductive imaging portion 23 to exhibit increasing amounts of average voltage at least up to a transition point 113, after which increasing amounts of AC voltage at charge roller 25 do not result in further increases in the average voltage exhibited by the photoconductive imaging portion 23, as represented by segment 114 of curve 110. For instance, given the particular dimensions, materials, spacing, etc. of a given charge roller and photoconductive imaging portion, the curve 110 flattens out in segment 112 at an average voltage of 1000 volts of the photoconductive imaging portion 23 in some examples. In some examples, the transition point 113 sometimes may be referred to as a knee voltage.

As further shown in FIG. 4, the total charge exposed (e.g. $2^{nd}$ y-axis 103) to the photoconductive imaging portion 23 also may be observed as function of increasing AC voltage of the charge roller (e.g. x-axis 101). In particular, segment 122 of curve 120 may represent that as the AC voltage of the charge roller is increased from zero to an AC voltage (e.g. 600 Volts) which roughly corresponds to the AC voltage corresponding to the transition point 113, the total voltage change ($2^{nd}$ y-axis 103) of the photoconductive imaging portion 103 exhibits a small increase, on the order of ones voltage. In one aspect, segment 122 extends up to a transition point 123, from which a segment 124 extends further along the x-axis 101 and $2^{nd}$ y-axis 103. As further represented by segment 124 of curve 120 in FIG. 4, additional small increases in the AC voltage of the charge roller 25 may produce significant increases in the total charge exposed to ($2^{nd}$ y-axis 103) the photoconductive imaging portion 23. For example, increasing the AC voltage of the charge roller 25 from 600 Volts to 800 Volts, may cause a total exposed charge change (at photoconductive imaging portion 23) of about 0.8 $nC/cm^2$ without producing an increase in the average voltage of the photoconductive imaging portion 23. Because this total exposed charges shown in FIG. 4 is representative of the total amount of charges transferred from the charge roller 25 to the photoconductive imaging portion 23, this curve indicates that a large amount of charges were exposed to and/or transferred to the photoconductive imaging portion 23 yet a substantial portion of those charges did not contribute to achieving or maintaining the target average voltage (e.g. 1000 Volts) of the photoconductive imaging portion 23. This indication is further associated with the recognition that such exposure and/or transfer of excess charges may contribute to premature degradation of the photoconductive imaging portion 23.

Accordingly, it may be observed that determination of an AC voltage setpoint according to examples of the present disclosure may comprise a minimum value above the transition point 113 on curve 110 and/or at transition point 123 on curve 120, and at or below a maximum value along segment 124 of curve 120, which does not result in exposure of and/or transfer of excess charges to the photoconductive imaging portion 23.

Figure 5:
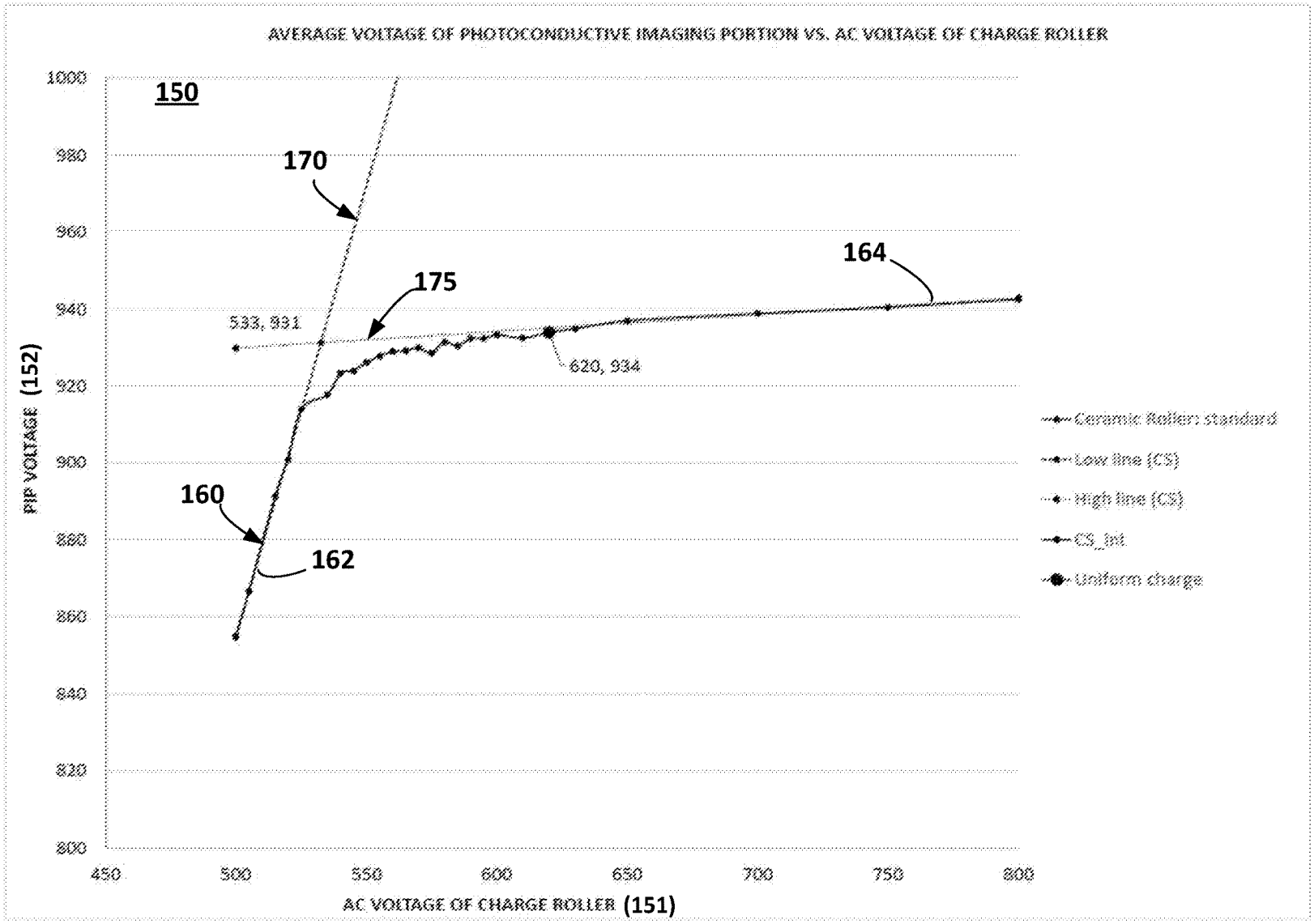
FIG. 5 is a graph including an example plot of an average voltage of a photoconductive imaging portion relative to an AC voltage of a charge roller.

FIG. 5 is a graph 150 including an example plot of an average voltage of a photoconductive imaging portion relative to an AC voltage of a charge roller. In some examples, the voltages represented in FIG. 5 correspond to an example charge roller 25 and/or example photoconductive imaging portion 23 comprising at least some of substantially the same features and attributes as represented in association with at least FIGS. 1-4. In some examples, it will be understood that graph 150 may comprise at least some of substantially the same features and/or type of information represented via at least curve 110 in graph 100 in FIG. 4. For instance, in some examples segment 162 of curve 160 in FIG. 5 may generally correspond to the type of information represented by segment 112 of curve 110 in FIG. 4, while in some examples, the segment 164 of curve 160 in FIG. 5 may generally correspond to the type of information represented by segment 114 of curve 110 in FIG. 4. Similarly, in some examples, the transition region 163 of curve 160 in FIG. 5 may generally correspond to the type of information represented by transition portion 113 of curve 110 in FIG. 4.

With this in mind, in some examples determination of an AC voltage setpoint may comprise observing a first slope 170 to represent the path of first segment 162 and which corresponds to the situation in which increasing the AC voltage of the charge roller 25 causes significant increases in the average voltage of the photoconductive imaging portion 23. However, in some examples, determination of the AC voltage setpoint may comprise observing that a second slope 175 may be drawn along at least some of the data points forming segment 164 (to represent the path of second segment 164), which corresponds to the situation in which increases in the AC voltage of the charge roller cause relatively small increases in the average voltage of the photoconductive imaging portion 23. In some examples, determination of the AC voltage setpoint may exclude determining and/or observing the first slope 170.

In some examples, determination of the AC voltage setpoint in association with the second slope 175 may comprise observing data points which begin to fall below (e.g. diverge) from second slope 175 for lesser values of the AC voltage of the charge roller in order to identify a deviation in voltage of the data point (e.g. 620) from the second slope 175. By setting a threshold for this voltage deviation (i.e. voltage deviation threshold) such as 1 Volt, one may determine that a lowest AC voltage which still may be considered to reasonably fall along second slope 175. Further details regarding such thresholds are provide below.

It is desirable to ensure that the AC voltage setpoint is at least along second slope 175 because AC voltages which do not reasonably fall along second slope 175 may produce non-uniformity in imaging (observed along segment 162 and slope 170).

In some such examples, the AC setpoint corresponds to a point at which a further increase in the AC voltage of the charge roller 25 results in less than a predetermined voltage change (e.g. 1 Volt) in the voltage deviation of the photoconductive imaging portion 23 from the above-threshold trend line 175. In some such examples, the predetermined voltage change may sometimes be referred to as a threshold. In some examples, this arrangement may be expressed as the AC voltage setpoint corresponding to a point along a slope of a first curve portion of a voltage of the photoconductive imaging portion 23, as a function of the AC voltage of charge roller 25, at which a further increase in the AC voltage of the charge roller 25 results in less than a threshold increase in the voltage of the photoconductive imaging portion 23.

In some examples, the threshold may comprise on the order of 0.5 Volts (e.g. 0.3, 0.4, 0.5, 0.6, 0.7 Volts), on the order of 1 Volt (e.g. 0.8, 0.9, 1, 1.1, 1.2 Volts), on the order of 1.5 Volts (e.g. 1.4, 1.5, 1.6, 1.7 Volts).

Figure 6:
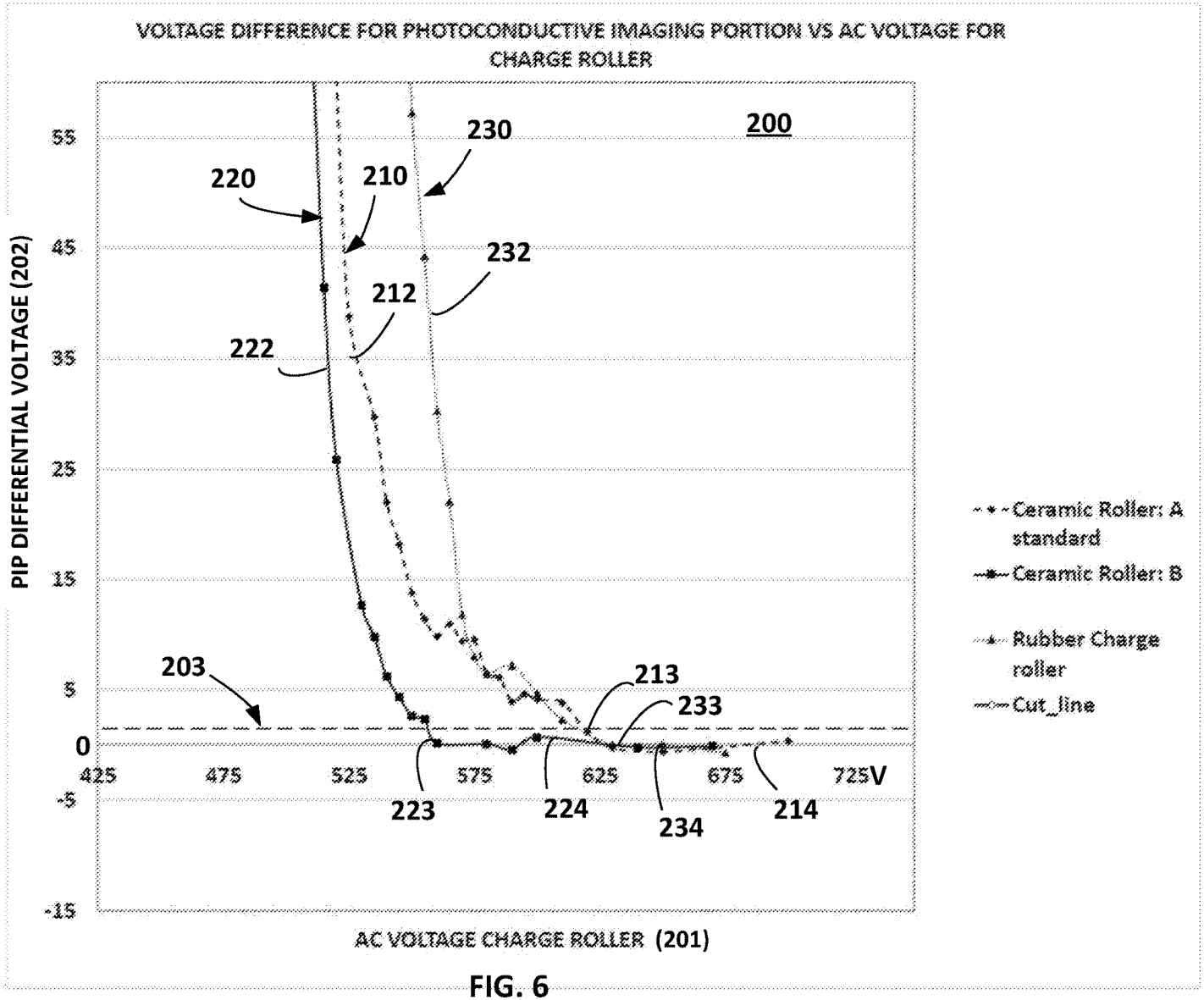
FIG. 6 is a graph including an example plot of voltage change for a photoconductive imaging portion relative to an AC voltage of a charge roller.

FIG. 6 is a graph 200 including an example plot of voltage deviation for a photoconductive imaging portion from the above-threshold trend line 175, relative to an AC voltage of a charge roller. In some examples, the voltages deviation represented in FIG. 6 correspond to an example charge roller 25 and/or example photoconductive imaging portion 23 comprising at least some of substantially the same features and attributes as represented in association with at least FIGS. 1-3. In some examples, it will be understood that graph 200 may comprise at least some of substantially the same features and/or type of information represented via at least curve 110 in graph 100 in FIG. 4 and/or via at least curve 160 in graph 150 in FIG. 5.

In general terms, graph 200 in FIG. 6 represents a voltage deviation for a photoconductive imaging portion from the above-threshold trend line 175, as a function of AC voltage for a charge roller. As shown in FIG. 6, the graph 200 comprises an x-axis 201 corresponding to an AC voltage of the charge roller 25, while a y-axis 202 corresponds to a voltage deviation of the PIP from the above-threshold trend line. In one aspect, the voltage deviation represented along y-axis 202 corresponds to a difference in voltage exhibited by the photoconductive imaging portion 23 relative to above-threshold trend line 175 as a function of the AC voltage at the charge roller 25 (x-axis 201), as further described below.

As further shown in FIG. 6, a first curve 210 is plotted according to the first y-axis 202 relative to the x-axis 201. The first curve 210 includes a first segment 212 which represents the situation in which increasing amounts of AC voltage at charge roller 25 causes the photoconductive imaging portion 23 to exhibit increasing amounts of voltage deviation at least up to a transition point 213, after which increasing amounts of AC voltage at charge roller 25 do not result in further increases in the voltage deviation exhibited by the photoconductive imaging portion 23, as represented by the relative flat segment 214 of curve 210. For instance, given the particular dimensions, materials, spacing, etc. of a given charge roller and photoconductive imaging portion, the curve 210 flattens out in segment 214 (no further voltage deviation observed at photoconductive imaging portion 214) at an AC voltage of about 630 volts of the photoconductive imaging portion 23 in some examples.

For instance, as may be observed from first segment 212 of curve 210 of FIG. 6, relative small increases in AC voltage result in relatively large voltage deviation (e.g. increases) for the photoconductive imaging portion 23. However, as the increases in AC voltage enter the transition region 215, the relatively small increases in AC voltage produce relatively small voltage deviation (e.g. increases) in the photoconductive imaging portion 23 until a point (e.g. 213) is reached at which further relatively small increases in AC voltage no longer results in an observable voltage deviation at the photoconductive imaging portion 23, as represented by the second segment 214 extending from the point 213.

In some examples, a threshold of voltage deviation (as represented via dashed line 203 in FIG. 6) may be defined at which sufficiently uniform imaging may occur even though the point at which a curve (e.g. 210, 220, 230) crosses the threshold is less than the saturation point at which the voltage deviation is zero for further increases in an AC voltage of the charge roller. As previously described, the voltage deviation threshold may comprise on the order of 0.5 Volts (e.g. 0.3, 0.4, 0.5, 0.6, 0.7) in some examples, while in some examples, the voltage deviation threshold may comprise on the order of 1 Volt (e.g. 0.8, 0.9, 1, 1.1, 1.2), and in some examples, the voltage deviation threshold may comprise on the order of 1.5 Volts (e.g. 1.3, 1.4, 1.5, 1.6, 1.7). However, at some point higher thresholds will not correspond to an AC voltage for which uniform imaging is observed.

As previously noted, in some examples the determination of an AC voltage setpoint may be further determined or alternatively determined via other criteria. For instance, in some examples, the AC setpoint may be determined according to quantitative values of the total charge transferred.

In some examples, the determination of an AC voltage setpoint via at least the tools provided and/or represented via FIGS. 4-6 may be used to determine a minimum value and/or a maximum value of an AC voltage setpoint according to the various examples throughout the present disclosure.

In some examples, such as via the control portion 32 (FIG. 2), the printer 30 (also printer 20) is to operate without adjusting the AC voltage setpoint in relation to a thickness parameter of the photoconductive imaging portion over the lifetime of the photoconductive imaging portion.

In some examples, in addition to or as an alternative to measuring a lifetime of the photoconductive imaging portion 23 according to a quantity of units/use (e.g. impressions), the lifetime may be defined by a threshold related to a reduced thickness of photoconductive imaging portion 23, such as upon the photoconductive imaging portion 23 exhibiting a reduced thickness according to threshold. In some such examples, the threshold may correspond to an original thickness of photoconductive imaging portion 23 being reduced by an order of one micron over a lifetime of the photoconductive imaging portion 23. In some such examples, "on the order of" of one micron corresponds to 0.8, 0.9, 0.95, 1.05, 1.1, 1.2 microns. In some examples, "on the order of" 1.5 microns corresponds to 1.3, 1.4, 1.5, 1.6, 1.7 microns. In some examples, the thickness may be reduced less than an order of two microns (e.g. 1.8, 1.9, 2, 2.1, 2.2) over a lifetime of the photoconductive imaging portion. With this in mind, in some examples, over a lifetime of the photoconductive imaging portion 23, its thickness will be reduced less than one micron.

In some such examples, these minimal reductions in the thickness of the photoconductive imaging portion 23 (over a lifetime of the photoconductive imaging portion) are associated with the electrophotographic printer 20, 30 comprising a liquid electrophotographic printer such that the charge-transferring relation of the charge roller relative to the photoconductive imaging portion 23 does not cause abrasion of the photoconductive imaging portion 23, which may sometimes result from dry electrophotography.

Figure 7:
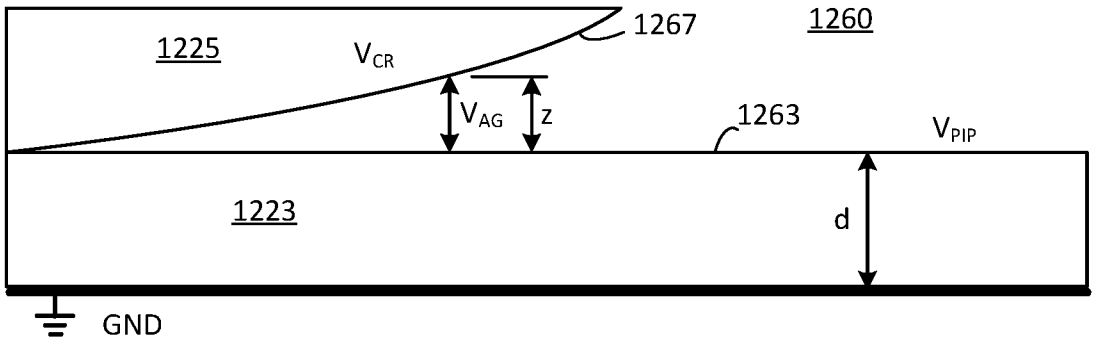
FIG. 7 is a side view schematically representing an example portion of an electrophotographic printer including a charge roller positioned relative to an example photoconductive imaging portion.

FIG. 7 is a diagram including a side view schematically representing a portion of an example electrophotographic printer 1260 in which a charge roller 1225 is in rolling contact with, and charge-transferring relation to, a photoconductive imaging portion 1223. In some examples, the charge roller 1225 comprises at least some of substantially the same features and attributes as charge roller 25 (FIGS. 1-3) and/or photoconductive imaging portion 1223 comprises at least some of substantially the same features and attributes as photoconductive imaging portion 23 (FIGS. 1-2). In one aspect, the example portion of printer 1260 provides a reference by which the Paschen threshold voltage may be at least partially described and via which a threshold charging voltage for the charge roller 1223 may be determined.

In general terms, a Paschen threshold voltage, $V_{PS}(z)$, between two parallel conductive plates is a function of an air gap z between the respective plates. However, in some examples a charging threshold voltage $V_{th}$ for a charge roller 1225 in rolling contact with a photoconductive imaging portion 1223 may be a function of a variable gap, such as an air gap (z) which may vary from 0 to a few tens of millimeters. Moreover, the applied voltage ($V_{CR}$) from the charge roller 1225 is divided between the air (e.g. $V_{AG}$) and photoconductive imaging portion 1123 (e.g. $V_{PIP}$). With this in mind, the charging threshold voltage ($V_{th}$) by the contact charge roller 1225 can be calculated from the minimum voltage across air ($V_{AG}$) that meets a Paschen threshold condition. The voltage across air ($V_{AG}$ or $V_a$) at a given charge roller voltage can be expressed by a voltage divider rule as:

$$V_a = V_{CR} \cdot \frac{z}{z + d/\varepsilon}, \quad \text{(Eq. 1)}$$

where $V_{CR}$ is the charge roller voltage, z is a size of the air gap, d is a photoconductor thickness, and c is a dielectric constant of photoconductor, such as photoconductive imaging portion 1223.

The charge roller voltage ($V_{CR}$) that results in the voltage across air to be the Paschen threshold voltage ($V_{PS}$) will be the charging threshold voltage ($V_{th}$). Since both the Paschen threshold voltage ($V_{PS}$) and voltage across air ($V_{AG}$ or $V_a$) depends upon the air gap z, it will be understood that identification of the charging threshold voltage may be solved graphically or through other means.

It may be further understood that a charging threshold voltage ($V_{TH}$) will be different for different sized air gaps between the charge roller 1225 and the photoconductive imaging portion 1223. In some examples, the charging threshold voltage ($V_{TH}$) can be calculated from the equation $$V_p = V_{CR} - V_{PS}(z) \cdot \frac{z + d/\varepsilon}{z}, \quad \text{(Eq. 2)}$$

where $V_P$ is a voltage of the photoconductive imaging portion 1223, $V_{CR}$ is a voltage of the charge roller, and $V_{PS}$ is a Paschen threshold voltage. Meanwhile, z represents a size of the air gap, d represents a thickness of the photoconductive imaging portion 1223, and c represents the dielectric constant of the photoconductive imaging portion 1223. Charging will occur when $V_p>0$, and therefore, charging threshold voltage is $V_{TH}=V_{CR}=V_{PS}(g)\cdot(g+d/\varepsilon)/g$, where g is the gap between charge roller 1225 and photoconductive imaging portion 1223.

Among other information, determination of the above-described charging threshold voltage may be used to help select a current, AC voltage, and/or DC voltage which will cause the charge roller and the spaced apart photoconductive imaging portion to transfer charges to the photoconductive imaging portion without exhibiting non-uniform charging behavior, such as but not limited to, filamentary streamer charges. For example, such filamentary streamer charges are further described in Chang U.S. Pat. No. 9,423,717, "Charge Roller For Electrophotographic Printer", issued Aug. 23, 2016 and/or Chang U.S. Patent Publication 2014/0369717, "Printing With Metal-Surface Charge Element in Glow Discharge Regime", published Dec. 18, 2014.

Figure 8:
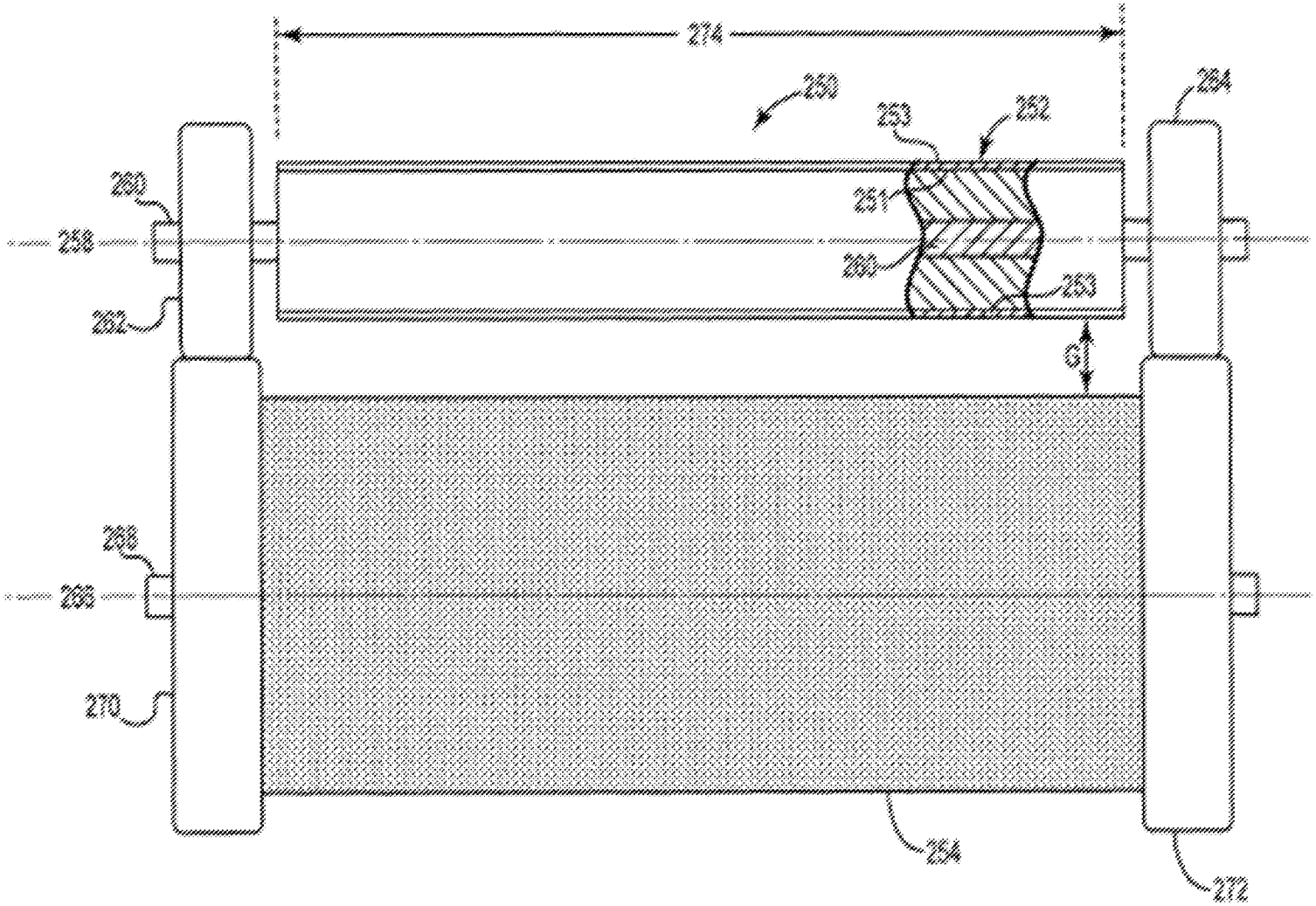
FIG. 8 is a side view schematically representing an example charge roller and associated elements of an example electrophotographic printer.

FIG. 8 is a side view schematically representing an example printing system 250 having a charge roller 252 rotationally coupled to, but spaced apart from, an external surface 254 of a photoconductive imaging portion by a fixed air gap G. In general terms, the example printing system 250 includes at least some of substantially the same features and attributes as the electrophotographic printers, and portions thereof, as described in association with FIGS. 1-7. In some examples, the gap (G) is any distance between 0 and 80 micrometers (μm). In some examples, the gap (G) is between about 20 micrometers and about 80 micrometers (μm). In some such examples, the upper limit (e.g. 80 micrometers) of the range may be even larger if adequate, uniform charge transfer can be achieved from the charge roller 252 to the surface 254 of the photoconductive imaging portion.

As further shown in FIG. 8, the charge roller 252 rotates about an axis 258 by means of a shaft 260 coupled to a drive wheel 262 on one end and a drive wheel 264 on the other end. Meanwhile, the surface 254 of the photoconductive imaging portion rotates about an axis 266 by means of a shaft 268 with a first disk 270 on one end and a second disk 272 on the other end. With this arrangement, the charge-roller drive wheel 262 engages the first disk 270, and the charge-roller drive wheel 264 engages the second disk 272. In some examples, there may be more or fewer drive wheels and disks, and rotational torque to the photoconductive imaging portion may be provided by a motor (not shown) through a gear (not shown) attached to the shaft 268. Finally, the charge roller 252 defines an image area 274 relative to the photoconductive imaging surface 254.

Figure 9:
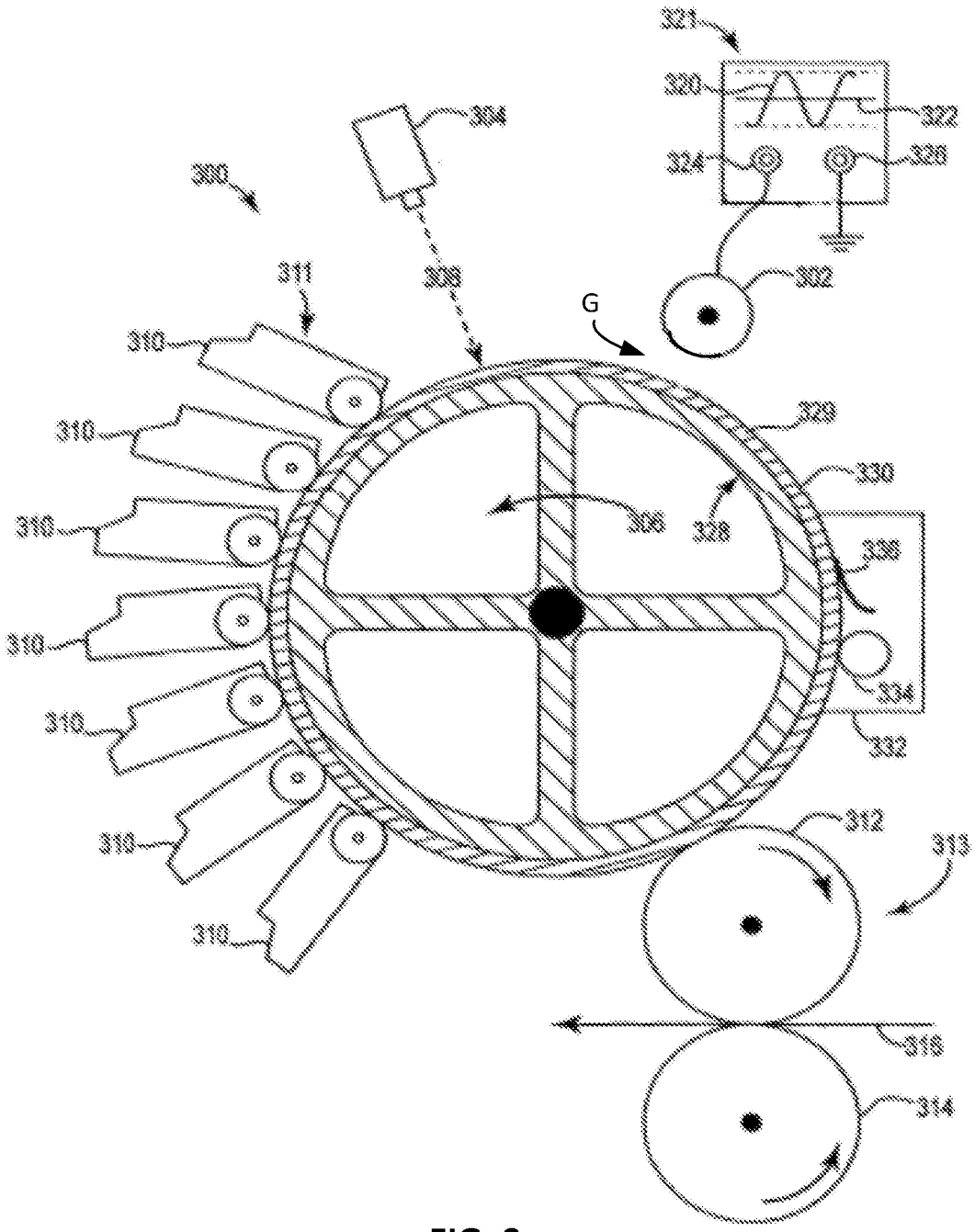
FIG. 9 is a side view schematically representing an example electrophotographic printer.

FIG. 9 is a side view schematically illustrating an example printer 300 having a charge roller 302 in charge-transferring relation with a photoconductive imaging portion 330, according to one example of the present disclosure. In one example, charge roller 302 includes at least some of substantially the same features and attributes as one of charge rollers positioned in charge-transferring relation to a photoconductive imaging portion, as previously described in association with at least FIGS. 1-8. Accordingly, upon installing charge roller 302 into the printer 300 at the time of assembly and/or a later calibration, an AC voltage setpoint for a charge roller may be determined according to the examples of the present disclosure as described in association with at least FIGS. 1-8 and 10A-11. This determination of the AC voltage setpoint may be used to implement substantially uniform charging of the photoconductive imaging portion 330 via the charge roller 302, as previously described in association with at least FIGS. 1-8.

In one example, printer 300 comprises an electrophotographic printer, and in some such examples, printer 300 comprises a liquid electrophotographic printer.

As shown in FIG. 9, printer 300 includes a charge roller 302, a photoconductive imaging portion 330, a discharge source 304, a developer array 311, a transfer unit 313, a cleaner 332, and a power supply 321. In one aspect, the charge roller 302 is in charge-transferring relation to photoconductive imaging portion 330 according to an AC voltage setpoint which can produce a substantially uniform charge on photoconductive imaging portion 330 while promoting longevity of the photoconductive imaging portion 330, as previously described in various examples of the present disclosure. It also will be understood that in some examples printer 300 may comprise charge roller 302 operating in rolling contact, charge-transferring relation to photoconductive imaging portion 330.

In one aspect, the discharge source 304 is aimed at the imaging surface 330 as indicated by an arrow 308. At least one ink developer roller 310 of array 311 is disposed in ink-dispensing relation with the imaging surface 330. While FIG. 9 depicts one example including seven ink dispenser rollers 310 in an array 311, in other examples fewer or more ink dispenser rollers 310 may be used. The transfer unit 313 is generally in ink-transferring relation with the photoconductive imaging portion surface 330 and defines a media movement path 316.

In some examples, the transfer unit 313 comprises an intermediate transfer drum 312 and an impression drum 314. The transfer drum 312 is rotationally coupled to and in direct contact with the photoconductive imaging portion 330 while the impression drum 314 is rotationally coupled to the intermediate transfer drum 312. The paper movement path 316 is defined between the intermediate transfer drum 312 and the impression drum 314.

In some examples, photoconductive imaging portion 330 comprises a photoconductive sheet 329 carried by a drum 328. In some instances, the photoconductive sheet 329 is referred to as an organic photoconductor (OPC) because of the organic material forming the photoconductive sheet 329. In other instances, the photoconductive sheet 329 is referred to as a photo imaging plate (PIP). As discussed previously, fabric or other material (not shown) may be disposed between the drum 328 and the photoconductive sheet 329. In some examples, the photoconductive imaging portion 330 may comprise a dielectric drum or a photoconductor drum.

In some examples, the discharge source 304 comprises a laser. In operation, when a beam of light from the laser reaches points on the electrostatically-charged photoconductive imaging portion 330, the light discharges the surface at those points. A charge image is formed on the photoconductive imaging portion 330 by scanning the beam of light across the imaging portion 330. In other examples, other types of image-forming energy sources or addressable discharging systems are used, such as an ion head or other gated atmospheric charge source. The particular type of image-forming energy source used in printer 300 depends on what kind of imaging surface is being used.

In one example, printer 300 includes cleaner 332 as noted above. For instance, cleaner 332 includes a roller element 334 and a scraping or brushing element 336, or other devices to remove any excess ink remaining on the imaging surface 330 after transferring imaged ink to the transfer roller 312. In some examples, roller element 334 includes a single roller while in other examples, roller element 334 includes at least two rollers, such as one wetting roller and one sponge roller.

In one example, the power supply 321 provides electric power with an AC component 320 and a DC component 322. The power supply is connected to the charge roller 302 through a first terminal 324 in electrical communication with the charge roller 302 and a second terminal 326 in electrical communication with ground.

In some examples, a voltage potential between the charge roller 302 and the ground plane (associated with the photoconductive imaging portion 330) is a combination of a DC voltage and an AC voltage. In other examples, the voltage between the charge roller 302 and the ground plane is a DC voltage.

Figure 10A:
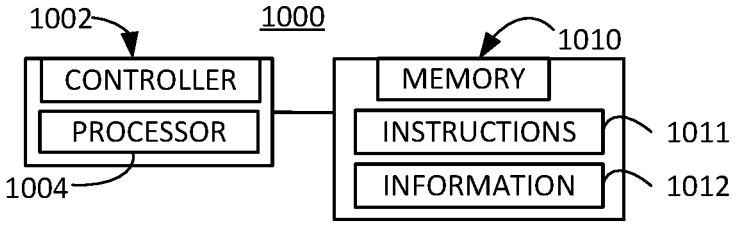
FIG. 10A is a block diagram schematically representing an example control portion.

FIG. 10A is a block diagram schematically representing an example control portion 1000. In some examples, control portion 1000 provides one example implementation of a control portion forming a part of, implementing, and/or generally managing the example portions of and/or entire electrophotographic printers, as well as the particular charge rollers, photoconductive conductive imaging portions, power supplies, voltage controls, elements, devices, instructions, information, engines, and/or methods, as described throughout examples of the present disclosure in association with FIGS. 1-9 and 10B-11.

In some examples, control portion 1000 includes a controller 1002 and a memory 1010. In general terms, controller 1002 of control portion 1000 comprises at least one processor 1004 and associated memories. The controller 1002 is electrically couplable to, and in communication with, memory 1010 to generate control signals to direct operation of at least some of the portions of, and/or entire, electrophotographic printers, such as but not limited to, the charge rollers, photoconductive imaging portions, power supplies, voltage controls, charge sources, transfer stations, developer units, user interfaces, instructions, information, engines, elements, functions, and/or methods, as described throughout examples of the present disclosure. In some examples, these generated control signals include, but are not limited to, employing instructions 1011 and/or information 1012 stored in memory 1010 to at least direct and manage determining an AC voltage setpoint for a charge roller relative to a photoconductor imaging portion, charging the charge roller, charging the photoconductor imaging portion, discharging portions of the photoconductor imaging portion to form an image, developing ink(s) on the image on discharged portions, transferring the ink image onto an intermediate transfer member and/or onto an image formation medium, etc. as described throughout the examples of the present disclosure in association with FIGS. 1-9 and 10B-11. In some instances, the controller 1002 or control portion 1000 may sometimes be referred to as being programmed to perform the above-identified actions, functions, etc. In some examples, at least some of the stored instructions 1011 are implemented as, or may be referred to as, a print engine or image formation engine. In some examples, at least some of the stored instructions 1011 and/or information 1012 may form at least part of, and/or, may be referred to as an AC voltage setpoint determination engine.

In response to or based upon commands received via a user interface (e.g. user interface 1020 in FIG. 11) and/or via machine readable instructions, controller 1002 generates control signals as described above in accordance with at least some of the examples of the present disclosure. In some examples, controller 1002 is embodied in a general purpose computing device while in some examples, controller 1002 is incorporated into or associated with at least some of the portions of, and/or the entire, electrophotographic printers, as well as the particular charge rollers, photoconductive imaging portions, power supplies, voltage controls, developer units, transfer stations, elements, devices, instructions, information, engines, functions, and/or method, etc. as described throughout examples of the present disclosure.

For purposes of this application, in reference to the controller 1002, the term "processor" shall mean a presently developed or future developed processor (or processing resources) that executes sequences of machine readable instructions contained in a memory. In some examples, execution of the sequences of machine readable instructions, such as those provided via memory 1010 of control portion 1000 cause the processor to perform the above-identified actions, such as operating controller 1002 to implement the image formation and charge roller voltage determination as generally described in (or consistent with) at least some examples of the present disclosure. The machine readable instructions may be loaded in a random access memory (RAM) for execution by the processor from their stored location in a read only memory (ROM), a mass storage device, or some other persistent storage (e.g., non-transitory tangible medium or non-volatile tangible medium), as represented by memory 1010. In some examples, memory 1010 comprises a computer readable tangible medium providing non-volatile storage of the machine readable instructions executable by a process of controller 1002. In some examples, the computer readable tangible medium may sometimes be referred to as, and/or comprise at least a portion of, a computer program product. In other examples, hard wired circuitry may be used in place of or in combination with machine readable instructions to implement the functions described. For instance, in some examples, at least the controller 1002 and/or other components of the control portion 1000 may be embodied as part of at least one application-specific integrated circuit (ASIC), at least one field-programmable gate array (FPGA), and the like. In at least some examples, the controller 1002 and/or other components of the control portion 100 are not limited to any specific combination of hardware circuitry and machine readable instructions, nor limited to any particular source for the machine readable instructions executed by the controller 1002.

In some examples, control portion 1000 may be entirely implemented within or by a stand-alone device.

In some examples, the control portion 1000 may be partially implemented in one of the image formation devices and partially implemented in a computing resource separate from, and independent of, the image formation devices but in communication with the image formation devices. For instance, in some examples control portion 1000 may be implemented via a server accessible via the cloud and/or other network pathways. In some examples, the control portion 1000 may be distributed or apportioned among multiple devices or resources such as among a server, an image formation device, and/or a user interface.

Figure 10B:
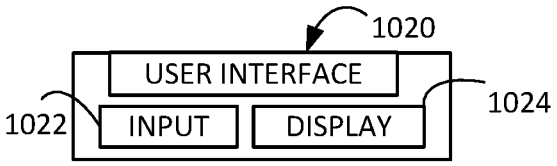
FIG. 10B is a block diagram schematically representing an example user interface.

In some examples, control portion 1000 includes, and/or is in communication with, a user interface 1020 as shown in FIG. 10B. In some examples, user interface 1020 comprises a user interface or other display that provides for the simultaneous display, activation, and/or operation of at least some of the portions of, and/or the entire, electrophotographic printers as well as the particular charge rollers, photoconductive imaging portions, power supplies, voltage controls, developer units, transfer stations, elements, devices, instructions, information, engines, functions, and/or method, etc., as described in association with FIGS. 1-9 and 10B-11. In some examples, at least some portions or aspects of the user interface 1020 are provided via a graphical user interface (GUI), and may comprise a display 1024 and input 1022.

Figure 11:
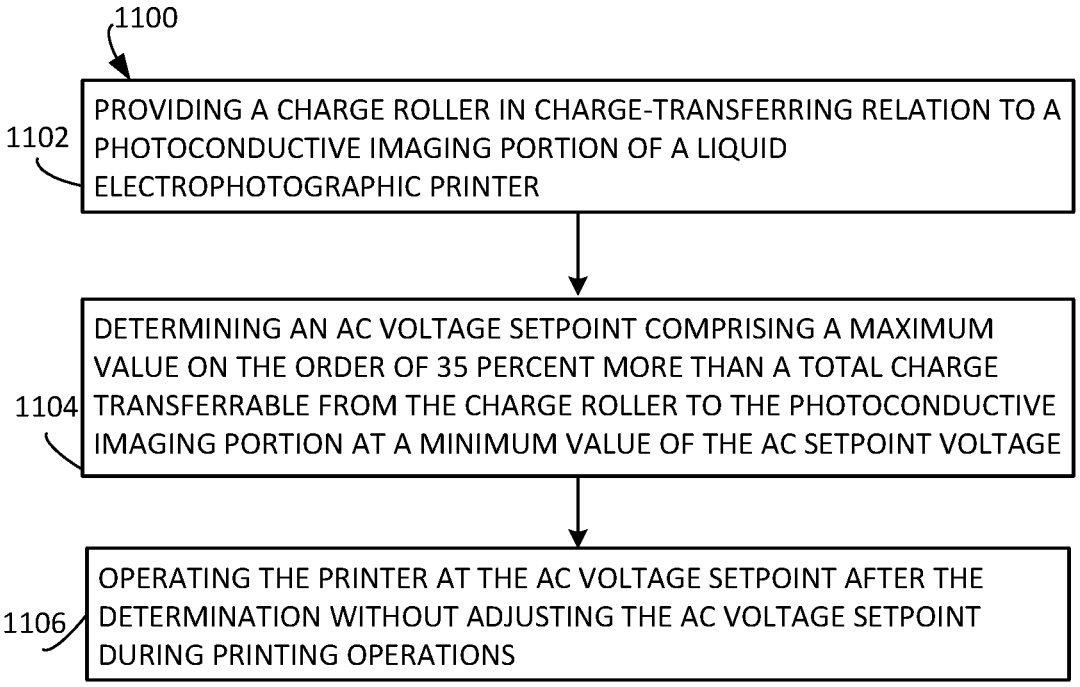
FIG. 11 is a flow diagram schematically representing an example method.

FIG. 11 is a flow diagram schematically representing an example method. In some examples, method 1100 may be performed via at least some of the same or substantially the same printers, charge rollers, power supplies, photoconductive imaging portions, portions, elements, control portion, methods, etc. as previously described in association with FIGS. 1A-10B. In some examples, method 1100 may be performed via at least some printers, charge rollers, power supplies, photoconductive imaging portions, portions, elements, control portion, methods, etc., other than those previously described in association with FIGS. 1A-10B.

As shown at 1102 of FIG. 11, in some examples method 1100 comprises providing a charge roller in charge-transferring relation to a photoconductive imaging portion of a liquid electrophotographic printer. In some examples, the charge roller is in non-contact, charge-transferring relation to the photoconductive imaging portion. In some examples, method 1100 may comprise a method to maximize longevity (e.g. a lifespan, lifetime, etc.) of a photoconductive imaging portion (e.g. 23 in FIG. 1).

As shown at 1104 in FIG. 11, in some examples method 1100 comprises determining an AC voltage setpoint of the charge roller, which comprises a maximum value on the order of 35 percent more than a total charge transferrable from the charge roller to the photoconductive imaging portion at a minimum value of the AC voltage setpoint. The maximum value may be on the order of 30 percent in some examples, on the order of 25 percent in some examples, on the order of 20 percent in some examples, and so on as in the previously described examples.

As shown at 1106 in FIG. 11, in some examples method 1100 comprises operating the printer without adjusting the AC voltage setpoint during printing operations. In some such examples, method 1100 may comprise operating the printer without actively adjusting the AC voltage setpoint during printing operations. Moreover, in some examples, the term "printing operations" may comprise at least some printing production operations to complete printing jobs, as opposed to pre-production testing and the like. In some examples, the operating the printer at the AC voltage setpoint (without adjusting the AC voltage setpoint or without actively adjusting the AC voltage setpoint) may be performed throughout at least a majority of a lifetime of the photoconductive imaging portion, with such "operation" of the printer comprising printing production operations in some examples.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein.

The invention claimed is:

1. A liquid electrophotographic printer comprising:

a photoconductive imaging portion;

a charge roller removably insertable into charge-transferring relation to the photoconductive imaging portion; and a control portion to:

determine an AC voltage setpoint of the charge roller, the determined AC voltage setpoint having a maximum voltage value and a minimum voltage value, wherein the maximum voltage value corresponds to a second total charge transferrable from the charge roller to the photoconductive imaging portion and wherein the minimum voltage value corresponds to a first total charge transferrable from the charge roller to the photoconductive imaging portion, wherein the maximum voltage value is on the order of 35 percent greater than the minimum voltage value, wherein the control portion is to operate the printer while maintaining the determined AC voltage setpoint independent of a thickness parameter of the photoconductive imaging portion over the lifetime of the photoconductive imaging portion.

2. The printer of claim 1, wherein the control portion is to operate the printer, after the determination, without adjusting the determined AC voltage setpoint during printing production operations throughout at least a majority of a lifetime of the photoconductive imaging portion.

3. The printer of claim 1, wherein the operation of the printer, via the control portion, while maintaining the determined AC voltage setpoint independent of a thickness parameter comprises:

wherein the control portion is to operate the printer without adjusting the determined AC voltage setpoint due to the thickness parameter of the photoconductive imaging portion over the lifetime of the photoconductive imaging portion.

4. The printer of claim 3, wherein the control portion is to operate the printer at the determined AC voltage setpoint throughout the lifetime of the photoconductive imaging portion such that an original thickness of photoconductive imaging portion is reduced less than an order of one micron over the lifetime of the photoconductive imaging portion.

5. The printer of claim 1, the control portion to perform the determination via an on-board measurement tool.

6. The printer of claim 1, the control portion to perform the determination without printing imaging output via the printer to observe non-uniformities in imaging.

7. The printer of claim 1, the control portion comprising:

a processor; and a non-transitory tangible medium storing machine-readable instructions, executable by the processor, to perform the determination and the operation.

8. The printer of claim 1, wherein the charge roller is in non-contact, charge-transferring relation to the photoconductive imaging portion and wherein the charge roller comprises an external surface comprising a hardness of about 5 to about 22 GPa Vickers hardness.

9. The printer of claim 1, wherein the electrophotographic printer further comprises:

a discharge source aimed at the photoconductive imaging portion;

at least one ink developer roller in ink-dispensing relation with the photoconductive imaging portion; and a transfer unit to arrange an image formation medium in ink-transferring relation with at least one of:

the photoconductive imaging portion; and an intermediate transfer member in ink-transferring relation to the photoconductive imaging portion.

10. The printer of claim 1, wherein the control portion is to operate the printer, after the determination, by maintaining the determined AC voltage setpoint during printing production operations throughout at least a majority of a lifetime of the photoconductive imaging portion.

11. A computer program product comprising:

a non-transitory tangible medium storing machine-readable instructions, executable by a processor, to:

determine an AC voltage setpoint of a removably insertable charge roller to be in charge-transferring relation to a photoconductive imaging portion of an electrophotographic printer, the determined AC voltage setpoint corresponding to at least a minimum voltage value as a point along of a linear slope of a voltage of the photoconductive imaging portion as a function of a first AC voltage of the charge roller, the minimum voltage value exceeding a knee voltage and wherein the point corresponds to a respective one of the voltage values at which a further increase in the first AC voltage of the charge roller results in an increase in the voltage of the photoconductive imaging portion which is less than a voltage deviation threshold on the order of 1.5 Volts.

12. The computer program product of claim 11, wherein the instructions are to determine a maximum voltage value of the determined AC voltage setpoint, wherein the maximum value corresponds to a second total charge transferrable to the photoconductive imaging portion from the charge roller and the minimum voltage value corresponds to a first total charge transferrable to the photoconductive imaging portion from the charge roller at which substantially uniform imaging occurs, wherein the maximum voltage value is on the order of 35 percent greater than the minimum voltage value.

13. A method comprising:

providing a charge roller in non-contact, charge-transferring relation to a photoconductive imaging portion of a liquid electrophotographic printer;

determining an AC voltage setpoint having a minimum voltage value and a maximum voltage value, wherein the maximum voltage value corresponds to a second total charge transferrable from the charge roller to the photoconductive imaging portion and the minimum voltage value corresponds to a first total charge transferrable from the charge roller to the photoconductive imaging portion, wherein the maximum voltage value is on the order of 35 percent greater than the minimum voltage value; and operating the printer at the determined AC voltage setpoint after the determination while maintaining the determined AC voltage setpoint during printing production operations throughout at least a majority of a lifetime of the photoconductive imaging portion.

14. The method of claim 13, wherein the maintaining the determined AC voltage setpoint comprises operating the printer at the determined AC voltage setpoint without actively adjusting the determined AC voltage setpoint throughout at least the majority of the lifetime of the photoconductive imaging portion.

15. The method of claim 13, wherein the lifetime comprises on the order of 80,000 cycles.

16. The method of claim 13, wherein the operating the printer comprises:

operating the printer while maintaining the determined AC voltage setpoint independent of a thickness parameter of the photoconductive imaging portion over the lifetime of the photoconductive imaging portion.

17. The method of claim 13, wherein the operating the printer comprises:

operating the printer at the determined AC voltage setpoint throughout the lifetime of the photoconductive imaging portion such that an original thickness of photoconductive imaging portion is reduced less than an order of one micron over the lifetime of the photoconductive imaging portion.

* * * * *